US010450725B2

(12) United States Patent
Kobayashi et al.

(10) Patent No.: US 10,450,725 B2
(45) Date of Patent: Oct. 22, 2019

(54) CONSTRUCTION MACHINE

(71) Applicant: HITACHI CONSTRUCTION MACHINERY CO., LTD., Tokyo (JP)

(72) Inventors: Hiroyuki Kobayashi, Tokyo (JP); Hiroshi Sakamoto, Tsuchiura (JP); Yasutaka Tsuruga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/768,841

(22) PCT Filed: Dec. 5, 2016

(86) PCT No.: PCT/JP2016/086026
§ 371 (c)(1),
(2) Date: Apr. 17, 2018

(87) PCT Pub. No.: WO2017/104459
PCT Pub. Date: Jun. 22, 2017

(65) Prior Publication Data

US 2018/0305898 A1 Oct. 25, 2018

(30) Foreign Application Priority Data

Dec. 18, 2015 (JP) ..... 2015-247138

(51) Int. Cl.
*E02F 9/22* (2006.01)
*E02F 9/20* (2006.01)
(Continued)

(52) U.S. Cl.
CPC ..... *E02F 9/2228* (2013.01); *E02F 9/20* (2013.01); *E02F 9/2267* (2013.01);
(Continued)

(58) Field of Classification Search
CPC ..... E02F 9/2228; E02F 9/2267; E02F 9/2271; E02F 9/2285; F15B 11/04; F15B 11/08
See application file for complete search history.

(56) References Cited

U.S. PATENT DOCUMENTS 7,802,971 B2 * 9/2010 Schneider ..... F04B 49/002 417/220
7,878,770 B2 * 2/2011 Oka ..... E02F 9/2228 417/278

(Continued)

FOREIGN PATENT DOCUMENTS

JP 05-195546 A 8/1993
JP 2012-141014 A 7/2012

OTHER PUBLICATIONS

International Search Report of PCT/JP2016/086026 dated Feb. 7, 2017.

(Continued)

*Primary Examiner* — Behrang Badii
*Assistant Examiner* — Daniel L Greene
(74) *Attorney, Agent, or Firm* — Mattingly & Malur, PC

(57) ABSTRACT

A construction machine that can ensure an initial response that varies in accordance with a hydraulic actuator in a similar fashion to a case of adopting a hydraulic pilot-type operation device is provided. A controller 100 of a hydraulic excavator outputs a command current for driving the corresponding solenoid proportional valve (i.e. some of solenoid proportional valves 41*a*, 41*b*, 42*a* to 42*d*, 43*a* to 43*d*, 44*a* and 44*b*) in response to an operation signal from an electric lever-type work operation device 2*a* or 2*b*, and includes a correction function to correct the command current such that the command current is higher than a target current corresponding to an operation amount of the operation device for preset predetermined time at a time of starting to operate the operation device from a neutral position thereof. This cor- (Continued)

rection function corrects only the command current to the bucket solenoid proportional valves 44*a* and 44*b*.

4 Claims, 8 Drawing Sheets

(51) Int. Cl.
*F15B 11/04* (2006.01)
*F15B 11/08* (2006.01)

(52) U.S. Cl.
CPC ..... *E02F 9/2271* (2013.01); *E02F 9/2285* (2013.01); *F15B 11/04* (2013.01); *F15B 11/08* (2013.01); *F15B 2211/30525* (2013.01); *F15B 2211/526* (2013.01); *F15B 2211/6653* (2013.01)

(56) References Cited

U.S. PATENT DOCUMENTS 8,701,396 B2 * 4/2014 Narotham ..... E02F 3/963 60/327
8,899,143 B2 * 12/2014 Ho ..... E02F 9/2214 91/358 R
2002/0014075 A1 * 2/2002 Sawada ..... F15B 11/163 60/468
2002/0104430 A1 * 8/2002 Yamaguchi ..... A01B 63/114 91/358 R
2009/0308603 A1 * 12/2009 Borgstadt ..... B25J 9/1664 166/250.15
2013/0263587 A1 * 10/2013 Azuma ..... E02F 9/2235 60/459
2015/0040552 A1 * 2/2015 Hashimoto ..... F15B 11/17 60/429
2016/0025113 A1 * 1/2016 Hiraku ..... E02F 9/2235 60/428
2017/0159265 A1 * 6/2017 Tomita ..... E02F 3/422
2018/0066416 A1 * 3/2018 Hijikata ..... F15B 20/00

OTHER PUBLICATIONS

International Preliminary Report on Patentability received in corresponding International Application No. PCT/JP2016/086026 dated Jun. 28, 2018.

* cited by examiner

CONSTRUCTION MACHINE

This application is a 371 of PCT/JP2016/086026 filed Dec. 5, 2016 which claims priority to Foreign Application No. 2015-247138 filed Dec. 18, 2015 in Japan.

TECHNICAL FIELD

The present invention relates to a construction machine such as a hydraulic excavator and particularly relates to a construction machine provided with an electric lever-type operation device.

BACKGROUND ART

A hydraulic excavator that is one type of construction machine includes a self-propelled lower travel structure, an upper swing structure swingably provided on an upper side of this lower travel structure, and a work device coupled to this upper swing structure. The work device includes, for example, a boom rotatably coupled to the upper swing structure, an arm rotatably coupled to the boom, and a bucket rotatably coupled to the arm. In addition, a plurality of hydraulic cylinders (specifically a boom cylinder, an arm cylinder, and a bucket cylinder) drive the boom, the arm, and the bucket to rotate. Each hydraulic actuator is driven by a hydraulic fluid supplied from a hydraulic pump via, for example, a hydraulic pilot-type directional control valve.

Types of operation devices operated by an operator include a hydraulic pilot-type operation device and an electric lever-type operation device. The hydraulic pilot-type operation device has a plurality of pilot valves corresponding to operation directions from a neutral position of an operation lever and each generating a pilot pressure in response to an operation amount of the operation lever. Each pilot valve outputs the pilot pressure to an operation section (pressure receiving section) of the corresponding directional control valve to drive the directional control valve.

The electric lever-type operation device has a plurality of potentiometers corresponding to operation directions from a neutral position of an operation lever and each generating an operation signal (electrical signal) in response to an operation amount of the operation lever. A controller generates a command current in response to the operation signal from each potentiometer, and outputs the command current to a solenoid section of a corresponding solenoid proportional valve to drive the solenoid proportional valve. The solenoid proportional valve generates a pilot pressure proportional to the command current, and outputs the pilot pressure to the operation section of the corresponding directional control valve to drive the directional control valve.

It is known that a driving system including the electric lever-type operation device described above, the controller, the solenoid proportional valves, and the directional control valves delay in an initial response of each hydraulic actuator (in other words, in a response of each hydraulic actuator at a time of starting to operate the operation lever from the neutral positions thereof), compared with a driving system including the hydraulic pilot-type operation device described above and the directional control valves. This is because signal generation of the operation device, signal output from the operation device to the controller, signal processing by the controller, and current output from the controller to the solenoid proportional valves cause a time delay. This is also because although a spool of each solenoid proportional valve is not completely closed yet right after the operation lever returns to the neutral position, the spool of the solenoid proportional valve is completely closed and the spool delays in an initial motion when a state in which the operation lever is at the neutral position continues.

Meanwhile, Patent Document 1 discloses a driving system that includes an electric lever-type operation device, a controller outputting a command current in response to an operation signal from the operation device, and solenoid proportional-type directional control valves each driven by the command current from the controller. In addition, the controller corrects the command current to the directional control valve in such a manner that the command current is higher than a target current corresponding to an operation amount of the operation device for preset predetermined time at a time of starting to operate the operation device from a neutral position thereof.

PRIOR ART DOCUMENT

Patent Document

Patent Document 1: JP-1993-195546-A

SUMMARY OF THE INVENTION

Problem to be Solved by the Invention

It is considered that a technique described in Patent Document 1 may be adopted in the driving system including the electric lever-type operation device described above, the controller, the solenoid proportional valves, and the directional control valves. That is, it is considered that the controller corrects the command current to each solenoid proportional valve at the time of starting to operate the operation device from a neutral position thereof in such a manner that the command current is higher than a target current corresponding to an operation amount of the operation device for preset predetermined time. If the controller corrects command currents to all the solenoid proportional valves in the same way, it is possible to improve initial characteristics of hydraulic actuators corresponding to the solenoid proportional valves in the same way. However, in the driving system including the hydraulic pilot-type operation device described above and the directional control valves, an initial response varies in accordance with a type of hydraulic actuator. Owing to this, setting the hydraulic actuators to have similar initial characteristics irrespective of types of hydraulic actuator possibly causes an operator to feel discomfort.

The initial responses of the hydraulic actuators in the driving system including the hydraulic pilot-type operation device and the directional control valves will be described in detail.

Because of a difference in load among the hydraulic actuators, the number of directional control valves corresponding to each hydraulic actuator often differs. Specifically, for example, there is a case in which one bucket cylinder is driven by the hydraulic fluid supplied via one directional control valve, while one arm cylinder or one boom cylinder is driven by the hydraulic fluid supplied via two directional control valves. In this case, the pilot pressure is output from one pilot valve to two operation sections of the two directional control valves with respect to each of the arm cylinder and the boom cylinder. Owing to this, a time lag increases until the pilot pressure rises and the directional control valves are moved, with the result that the initial responses of the directional control valves further delay.

Therefore, the initial response of the bucket cylinder is quicker than that of the arm cylinder and that of the boom cylinder.

Moreover, there is often a case in which a throttle or the like is provided as a shockless function with respect to the boom cylinder. In this case, the initial response of the arm cylinder is quicker than that of the boom cylinder.

The present invention has been achieved in the light of the circumstances described above, and an object of the present invention is to provide a construction machine that can ensure an initial response in accordance with a type of hydraulic actuator almost in a similar fashion to a case of adopting a hydraulic pilot-type operation device.

Means for Solving the Problem

To attain the object, the present invention provides a construction machine including: a plurality of hydraulic pumps; a first directional control valve that controls a flow of a hydraulic fluid from one of the hydraulic pumps to a first hydraulic actuator; a pair of first solenoid proportional valves that generate and output pilot pressure for driving the first directional control valve; a plurality of second directional control valves that control the flow of the hydraulic fluid from the plurality of hydraulic pumps to a second hydraulic actuator; a plurality of pairs of second solenoid proportional valves that generate and output pilot pressures for driving the plurality of second directional control valves; at least one electric lever-type operation device that outputs a first operation signal for operating the first hydraulic actuator and that outputs a second operation signal for operating the second hydraulic actuator; and a controller that outputs a first command current for driving the first solenoid proportional valve in response to the first operation signal from the operation device, and that outputs a second command current for driving the second solenoid proportional valves in response to the second operation signal from the operation device. The controller includes a correction function to correct a command current in such a manner that the command current is higher than a target current corresponding to an operation amount of the operation device for preset predetermined time at a time of starting to operate the operation device from a neutral position of the operation device, and the correction function of the controller corrects the command current such that the controller corrects the first command current and does not correct the second command current or such that a correction value of the first command current is higher than a correction value of the second command current.

Effect of the Invention

According to the present invention, even when the electric lever-type operation device is used, it is possible to ensure the initial response that varies in accordance with the type of hydraulic actuator almost in a similar fashion to a case of adopting the hydraulic pilot-type operation device.

MODES FOR CARRYING OUT THE INVENTION

A first embodiment of the present invention will be described with reference to the drawings.

Figure 1:
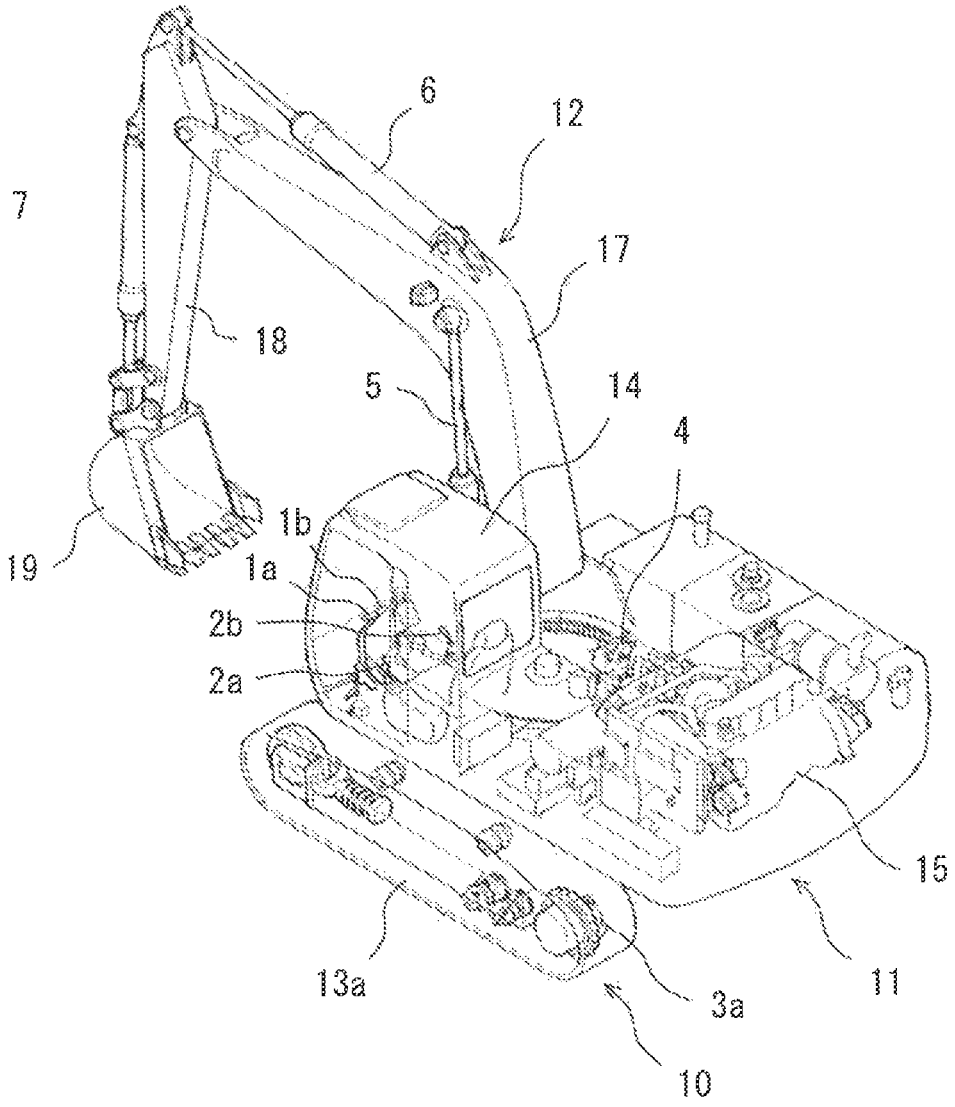
FIG. 1 is an oblique view showing a structure of a hydraulic excavator according to a first embodiment of the present invention.

FIG. 1 is an oblique view showing a structure of a hydraulic excavator according to the present embodiment, and showing mounted devices in a partial perspective view.

The hydraulic excavator of the present embodiment includes a self-propelled lower travel structure 10, an upper swing structure 11 swingably provided on an upper side of the lower travel structure 10, and a work device 12 coupled to a front side of the upper swing structure 11.

The lower travel structure 10 includes a track frame of a generally H-shape in a view from above and crawler travel devices 13*a* and 13*b* provided on left and right sides of this track frame (only the left travel device 13*a* is shown in FIG. 1). In the left travel device 13*a*, a left crawler (crawler belt) rotates frontward or rearward as a left travel motor 3*a* rotates frontward or rearward. Likewise, in the right travel device 13*b*, a right crawler (crawler belt) rotates frontward or rearward as a right travel motor 3*b* (not shown in FIG. 1 but shown in FIG. 2 to be described later) rotates frontward or rearward. The lower travel structure 10 is thereby configured to travel.

The upper swing structure 11 is configured to swing leftward or rightward as a swing motor 4 rotates. An operation room 14 is provided in a front portion of the upper swing structure 11, while devices including an engine 15 are mounted in a rear portion of the upper swing structure 11. Travel operation devices 1*a* and 1*b* and work operation devices 2*a* and 2*b* are provided within the operation room 14. Furthermore, a gate lock lever 16 that can be vertically operated (not shown in FIG. 1 for the sake of convenience but shown in FIG. 2 to be described later) is provided at an entrance of the operation room 14. The gate lock lever 16 is configured such that an operator is allowed to get in and out of the operation room 14 when the gate lock lever 16 is operated to a rising position and that the operator is prohibited from getting in and out of the operation room 14 when the gate lock lever 16 is operated to a lowering position.

The work device 12 includes a boom 17 rotatably coupled to a front side of the upper swing structure 11, an arm 18 rotatably coupled to the boom 17, and a bucket 19 rotatably coupled to the arm 18. The boom 17 rotates upward or downward by expansion or contraction of a boom cylinder 5. The arm 18 rotates in a crowding direction (pull-in direction) or a dumping direction (push-out direction) by expansion or contraction of an arm cylinder 6. The bucket 19 rotates in the crowding direction or the dumping direction by expansion or contraction of a bucket cylinder 7.

Figure 2:
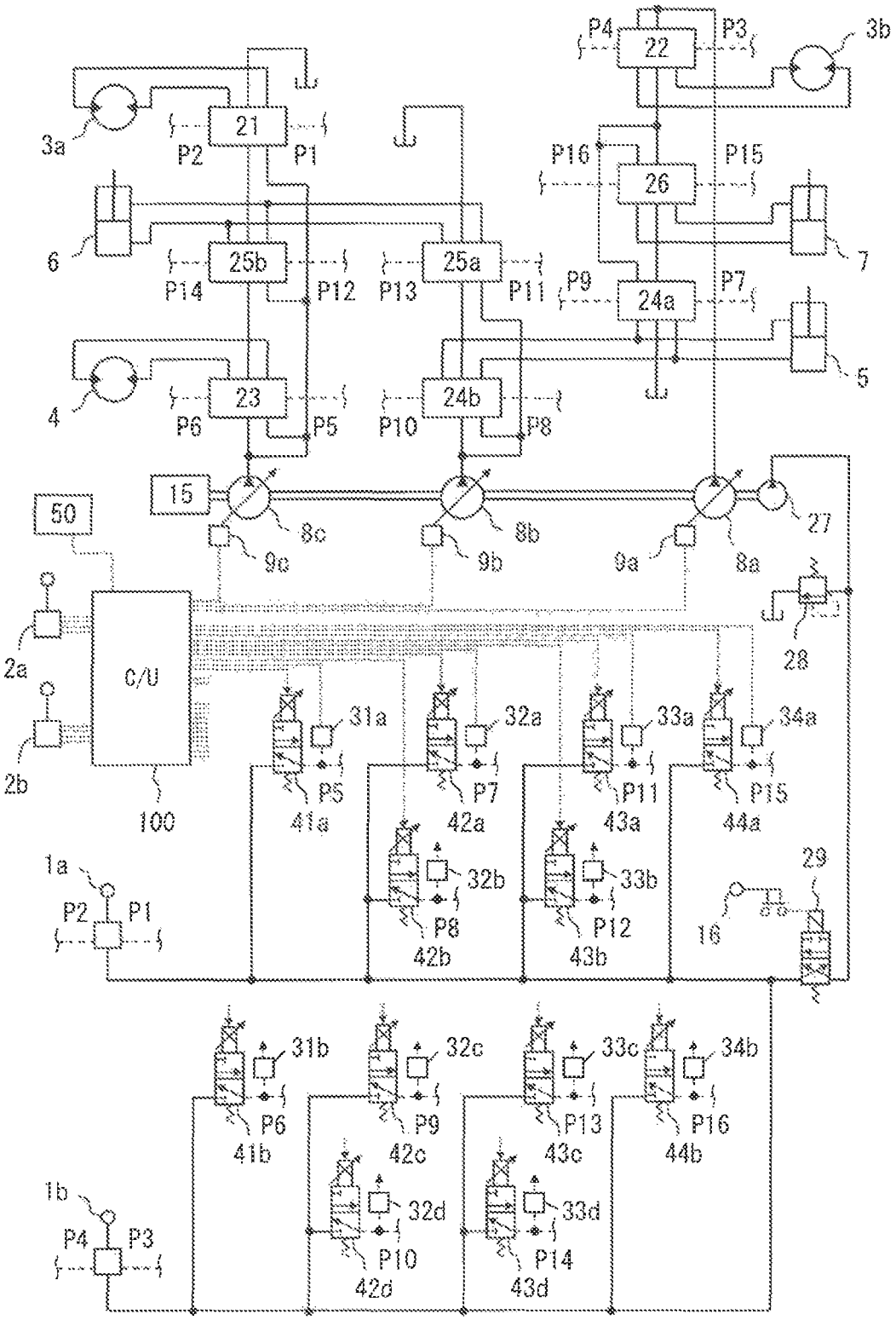
FIG. 2 shows a configuration of a driving system of the hydraulic excavator according to the first embodiment of the present invention.

FIG. 2 shows a configuration of a driving system of the hydraulic excavator according to the present embodiment. In FIG. 2, a main relief valve, a load check valve, a return circuit, a drain circuit, and the like are not shown for the sake of convenience.

The driving system of the present embodiment is generally configured with a main hydraulic control circuit and a pilot pressure control circuit.

The main hydraulic control circuit includes variable displacement hydraulic pumps 8*a*, 8*b*, and 8*c* driven by the engine 15, a plurality of hydraulic actuators (specifically, the left travel motor 3*a*, the right travel motor 3*b*, the swing motor 4, the boom cylinder 5, the arm cylinder 6, and the bucket cylinder 7 described above), and a plurality of hydraulic pilot-type directional control valves (specifically, a left travel directional control valve 21, a right travel directional control valve 22, a swing directional control valve 23, boom directional control valves 24*a* and 24*b*, arm directional control valves 25*a* and 25*b*, and a bucket directional control valve 26). Regulators 9*a*, 9*b*, and 9*c* changing pump capacities of the hydraulic pumps 8*a*, 8*b*, and 8*c* are provided in the hydraulic pumps 8*a*, 8*b*, and 8*c*, respectively.

All the directional control valves are center bypass directional control valves and classified into a first valve group connected to a delivery side of the hydraulic pump 8*a*, a second valve group connected to a delivery side of the hydraulic pump 8*b*, and a third valve group connected to a delivery side of the hydraulic pump 8*c*.

The first valve group includes the right travel directional control valve 22, the bucket directional control valve 26, and the boom directional control valve 24*a*. The right travel directional control valve 22 is connected to the bucket directional control valve 26 and the boom directional control valve 24*a* in tandem and connected upstream in a flow of a hydraulic fluid supplied from the hydraulic pump 8*a*. The bucket directional control valve 26 and the boom directional control valve 24*a* are connected in parallel. The hydraulic fluid from the hydraulic pump 8*a* is thereby preferentially supplied to the right travel directional control valve 22 over the bucket directional control valve 26 and the boom directional control valve 24*a*.

The second valve group includes the boom directional control valve 24*b* and the arm directional control valve 25*a*. The boom directional control valve 24*b* and the arm directional control valve 25*a* are connected in parallel. The third valve group includes the swing directional control valve 23, the arm directional control valve 25*b*, and the left travel directional control valve 21. The swing directional control valve 23, the arm directional control valve 25*b*, and the left travel directional control valve 21 are connected in parallel.

The pilot pressure control circuit includes a pilot pump 27 driven by the engine 15, the hydraulic pilot-type travel operation devices 1*a* and 1*b*, the electric lever-type work operation devices 2*a* and 2*b*, a controller (control unit) 100, a plurality of solenoid proportional valves (specifically, swing solenoid proportional valves 41*a* and 41*b*, boom solenoid proportional valves 42*a*, 42*b*, 42*c*, and 42*d*, arm solenoid proportional valves 43*a*, 43*b*, 43*c*, and 43*d*, and bucket solenoid proportional valves 44*a* and 44*b*).

The left travel operation device 1*a* has an operation lever that can be operated longitudinally and first and second pilot valves (not shown) each generating a pilot pressure using a delivery pressure from the pilot pump 27 as an original pressure.

The first pilot valve generates the pilot pressure in response to an operation amount of the operation lever in a direction from a neutral position to a front side thereof, outputs the pilot pressure to an operation section (pressure receiving section) on one side of the left travel directional control valve 21 via a pilot line P1, and drives a spool of the left travel directional control valve 21 to the other side thereof. The hydraulic fluid from the hydraulic pump 8*c* is thereby supplied to the left travel motor 3*a* via the left travel directional control valve 21 and the left travel motor 3*a* rotates frontward.

The second pilot valve generates the pilot pressure in response to an operation amount of the operation lever in a direction from the neutral position to a rear side thereof, outputs the pilot pressure to an operation section on the other side of the left travel directional control valve 21 via a pilot line P2, and drives the spool of the left travel directional control valve 21 to the one side thereof. The hydraulic fluid from the hydraulic pump 8*c* is thereby supplied to the left travel motor 3*a* via the left travel directional control valve 21 and the left travel motor 3*a* rotates rearward.

Likewise, the right travel operation device 1*b* has an operation lever that can be operated longitudinally and third and fourth pilot valves (not shown) each generating a pilot pressure using the delivery pressure from the pilot pump 27 as the original pressure.

The third pilot valve generates the pilot pressure in response to an operation amount of the operation lever in a direction from a neutral position to a front side thereof, outputs the pilot pressure to an operation section on one side of the right travel directional control valve 22 via a pilot line P3, and drives a spool of the right travel directional control valve 22 to the other side thereof. The hydraulic fluid from the hydraulic pump 8*a* is thereby supplied to the right travel motor 3*b* via the right travel directional control valve 22 and the right travel motor 3*b* rotates frontward.

The fourth pilot valve generates the pilot pressure in response to an operation amount of the operation lever in a direction from the neutral position to a rear side thereof, outputs the pilot pressure to an operation section on the other side of the right travel directional control valve 22 via a pilot line P4, and drives the spool of the right travel directional control valve 22 to the one side thereof. The hydraulic fluid from the hydraulic pump 8*a* is thereby supplied to the right travel motor 3*b* via the right travel directional control valve 22 and the right travel motor 3*b* rotates rearward.

The left work operation device 2*a* has an operation lever that can be operated longitudinally and laterally and first to fourth potentiometers (not shown). The first potentiometer generates an operation signal (electrical signal) in response to an operation amount of the operation lever in a direction from a neutral position to a front side thereof and outputs the operation signal to the controller 100. The second potentiometer generates an operation signal in response to an operation amount of the operation lever in a direction from the neutral position to a rear side thereof and outputs the operation signal to the controller 100. The third potentiometer generates an operation signal in response to an operation amount of the operation lever in a direction from the neutral position to a left side thereof and outputs the operation signal to the controller 100. The fourth potentiometer generates an operation signal in response to an operation amount of the operation lever in a direction from the neutral position to a right side thereof and outputs the operation signal to the controller 100.

Likewise, the right work operation device 2*b* has an operation lever that can be operated longitudinally and laterally and fifth to eighth potentiometers (not shown). The fifth potentiometer generates an operation signal in response to an operation amount of the operation lever in a direction from the neutral position to a front side thereof and outputs the operation signal to the controller 100. The sixth potentiometer generates an operation signal in response to an operation amount of the operation lever in a direction from the neutral position to a rear side thereof and outputs the operation signal to the controller 100. The seventh potentiometer generates an operation signal in response to an operation amount of the operation lever in a direction from the neutral position to a left side thereof and outputs the operation signal to the controller 100. The eighth potentiometer generates an operation signal in response to an operation amount of the operation lever in a direction from the neutral position to a right side thereof and outputs the operation signal to the controller 100.

The controller 100 generates a command current in response to the operation signal from the first potentiometer, outputs the command current to a solenoid section of the swing solenoid proportional valve 41*a*, and drives the swing solenoid proportional valve 41*a*. The swing solenoid proportional valve 41*a* generates a pilot pressure using the delivery pressure from the pilot pump 27 as the original pressure, outputs the pilot pressure to an operation section on one side of the swing directional control valve 23 via a pilot line P5, and drives a spool of the swing directional control valve 23 to the other side thereof. The hydraulic fluid from the hydraulic pump 8*c* is thereby supplied to the swing motor 4 via the swing directional control valve 23, and the swing motor 4 rotates in one direction.

Furthermore, the controller 100 generates a command current in response to the operation signal from the second potentiometer, outputs the command current to a solenoid section of the swing solenoid proportional valve 41*b*, and drives the swing solenoid proportional valve 41*b*. The swing solenoid proportional valve 41*b* generates a pilot pressure using the delivery pressure from the pilot pump 27 as the original pressure, outputs the pilot pressure to an operation section on the other side of the swing directional control valve 23 via a pilot line P6, and drives the spool of the swing directional control valve 23 to the one side thereof. The hydraulic fluid from the hydraulic pump 8*c* is thereby supplied to the swing motor 4 via the swing directional control valve 23, and the swing motor 4 rotates in an opposite direction.

It is noted that swing pressure sensors 31*a* and 31*b* are provided in the pilot lines P5 and P6 (in other words, secondary pressure sides of the swing solenoid proportional valves 41*a* and 41*b*), and an actual pilot pressure detected by each pressure sensor is output to the controller 100.

The controller 100 generates a command current in response to the operation signal from the third potentiometer, outputs the command current to solenoid sections of the arm solenoid proportional valves 43*a* and 43*b*, and drives the arm solenoid proportional valve 43*a* and 43*b*. The arm solenoid proportional valve 43*a* generates a pilot pressure using the delivery pressure from the pilot pump 27 as the original pressure, outputs the pilot pressure to an operation section on one side of the arm directional control valve 25*a* via a pilot line P11, and drives a spool of the arm directional control valve 25*a* to the other side thereof. The arm solenoid proportional valve 43*b* generates a pilot pressure using the delivery pressure from the pilot pump 27 as the original pressure, outputs the pilot pressure to an operation section on one side of the arm directional control valve 25*b* via a pilot line P12, and drives a spool of the arm directional control valve 25*b* to the other side thereof. The hydraulic fluid from the hydraulic pump 8*b* is thereby supplied to a rod side of the arm cylinder 6 via the arm directional control valve 25*a* and the hydraulic fluid from the hydraulic pump 8*c* is supplied to the rod side of the arm cylinder 6 via the arm directional control valve 25*b*, and the arm cylinder 6 is contracted.

Furthermore, the controller 100 generates a command current in response to the operation signal from the fourth potentiometer, outputs the command current to solenoid sections of the arm solenoid proportional valves 43*c* and 43*d*, and drives the arm solenoid proportional valve 43*c* and 43*d*. The arm solenoid proportional valve 43*c* generates a pilot pressure using the delivery pressure from the pilot pump 27 as the original pressure, outputs the pilot pressure to an operation section on the other side of the arm directional control valve 25*a* via a pilot line P13, and drives the spool of the arm directional control valve 25*a* to the one side thereof. The arm solenoid proportional valve 43*d* generates a pilot pressure using the delivery pressure from the pilot pump 27 as the original pressure, outputs the pilot pressure to an operation section on the other side of the arm directional control valve 25*b* via a pilot line P14, and drives the spool of the arm directional control valve 25*b* to the one side thereof. The hydraulic fluid from the hydraulic pump 8*b* is thereby supplied to a bottom side of the arm cylinder 6 via the arm directional control valve 25*a* and the hydraulic fluid from the hydraulic pump 8*c* is supplied to the bottom side of the arm cylinder 6 via the arm directional control valve 25*b*, and the arm cylinder 6 is expanded.

It is noted that arm pressure sensors 33*a*, 33*b*, 33*c*, and 33*d* are provided in the pilot lines P11, P12, P13, and P14 (in other words, secondary pressure sides of the arm solenoid proportional valves 43*a*, 43*b*, 43*c*, and 43*d*), and an actual pilot pressure detected by each pressure sensor is output to the controller 100.

The controller 100 generates a command current in response to the operation signal from the fifth potentiometer, outputs the command current to solenoid sections of the boom solenoid proportional valves 42*a* and 42*b*, and drives the boom solenoid proportional valve 42*a* and 42*b*. The boom solenoid proportional valve 42*a* generates a pilot pressure using the delivery pressure from the pilot pump 27 as the original pressure, outputs the pilot pressure to an operation section on one side of the boom directional control valve 24*a* via a pilot line P7, and drives a spool of the boom directional control valve 24*a* to the other side thereof. The boom solenoid proportional valve 42*b* generates a pilot pressure using the delivery pressure from the pilot pump 27 as the original pressure, outputs the pilot pressure to an operation section on one side of the boom directional control valve 24*b* via a pilot line P8, and drives a spool of the boom directional control valve 24*b* to the other side thereof. The hydraulic fluid from the hydraulic pump 8*a* is thereby supplied to a rod side of the boom cylinder 5 via the boom directional control valve 24*a* and the hydraulic fluid from the hydraulic pump 8*b* is supplied to the rod side of the boom cylinder 5 via the boom directional control valve 24*b*, and the boom cylinder 5 is contracted.

Furthermore, the controller 100 generates a command current in response to the operation signal from the sixth potentiometer, outputs the command current to solenoid sections of the boom solenoid proportional valves 42*c* and 42*d*, and drives the boom solenoid proportional valve 42*c* and 42*d*. The boom solenoid proportional valve 42*c* generates a pilot pressure using the delivery pressure from the pilot pump 27 as the original pressure, outputs the pilot pressure to an operation section on the other side of the boom directional control valve 24*a* via a pilot line P9, and drives the spool of the boom directional control valve 24*a* to the one side thereof. The boom solenoid proportional valve 42*d* generates a pilot pressure using the delivery pressure from the pilot pump 27 as the original pressure, outputs the pilot pressure to an operation section on the other side of the boom directional control valve 24*b* via a pilot line P10, and drives the spool of the boom directional control valve 24*b* to the one side thereof. The hydraulic fluid from the hydraulic pump 8*a* is thereby supplied to a bottom side of the boom cylinder 5 via the boom directional control valve 24*a* and the hydraulic fluid from the hydraulic pump 8*b* is supplied to the bottom side of the boom cylinder 5 via the boom directional control valve 24*b*, and the boom cylinder 5 is expanded.

It is noted that boom pressure sensors 32*a*, 32*b*, 32*c*, and 32*d* are provided in the pilot lines P7, P8, P9, and P10 (in other words, secondary pressure sides of the boom solenoid proportional valves 42*a*, 42*b*, 42*c*, and 42*d*), and an actual pilot pressure detected by each pressure sensor is output to the controller 100.

The controller 100 generates a command current in response to the operation signal from the seventh potentiometer, outputs the command current to a solenoid section of the bucket solenoid proportional valve 44*a*, and drives the bucket solenoid proportional valve 44*a*. The bucket solenoid proportional valve 44*a* generates a pilot pressure using the delivery pressure from the pilot pump 27 as the original pressure, outputs the pilot pressure to an operation section on one side of the bucket directional control valve 26 via a pilot line P15, and drives a spool of the bucket directional control valve 26 to the other side thereof. The hydraulic fluid from the hydraulic pump 8*a* is thereby supplied to a bottom side of the bucket cylinder 7 via the bucket directional control valve 26 and the bucket cylinder 7 is expanded.

Furthermore, the controller 100 generates a command current in response to the operation signal from the eighth potentiometer, outputs the command current to a solenoid section of the bucket solenoid proportional valve 44*b*, and drives the bucket solenoid proportional valve 44*b*. The bucket solenoid proportional valve 44*b* generates a pilot pressure using the delivery pressure from the pilot pump 27 as the original pressure, outputs the pilot pressure to an operation section on the other side of the bucket directional control valve 26 via a pilot line P16, and drives the spool of the bucket directional control valve 26 to the one side thereof. The hydraulic fluid from the hydraulic pump 8*a* is thereby supplied to a rod side of the bucket cylinder 7 via the bucket directional control valve 26 and the bucket cylinder 7 is contracted.

It is noted that bucket pressure sensors 34*a* and 34*b* are provided in the pilot lines P15 and P16 (in other words, secondary pressure sides of the bucket solenoid proportional valves 44*a* and 44*b*), and an actual pilot pressure detected by each pressure sensor is output to the controller 100.

The controller 100 determines whether abnormality occurs to each solenoid proportional valve on the basis of the command current to each solenoid proportional valve and the actual pilot pressure detected by the pressure sensor on the secondary pressure side thereof. When determining that abnormality occurs to the solenoid proportional valve, the controller 100 displays an abnormal state of the solenoid proportional valve on a display apparatus 50 to notify an operator of the abnormal state.

A relief valve 28 is provided on a delivery side of the pilot pump 27 and configured to specify an upper limit value of the delivery pressure of the pilot pump 27. In addition, a gate lock valve 29 is provided between the pilot pump 27 and the first to fourth pilot valves and the solenoid proportional valves 41*a*, 41*b*, 42*a* to 42*d*, 43*a* to 43*d*, 44*a* and 44*b* described above.

When the gate lock lever 16 is operated to a rising position (lock position), a switch is opened and a solenoid section of the gate lock valve 29 is not excited; thus, the gate lock valve 29 is located at a neutral position that is a lower side in FIG. 2. Supply of the hydraulic fluid from the pilot valve 27 to the first to fourth pilot valves and the solenoid proportional valves 41*a*, 41*b*, 42*a* to 42*d*, 43*a* to 43*d*, 44*a* and 44*b* described above is thereby interrupted. Therefore, the hydraulic actuators are made inoperable. On the other hand, when the gate lock lever 16 is operated to a lowering position (unlock position), the switch is closed and the solenoid section of the gate lock valve 29 is excited; thus, the gate lock valve 29 is located at a switch position that is an upper side in FIG. 2. The hydraulic fluid is thereby supplied from the pilot valve 27 to the first to fourth pilot valves and the solenoid proportional valves 41*a*, 41*b*, 42*a* to 42*d*, 43*a* to 43*d*, 44*a* and 44*b* described above. Therefore, the hydraulic actuators are made operable.

Figure 3:
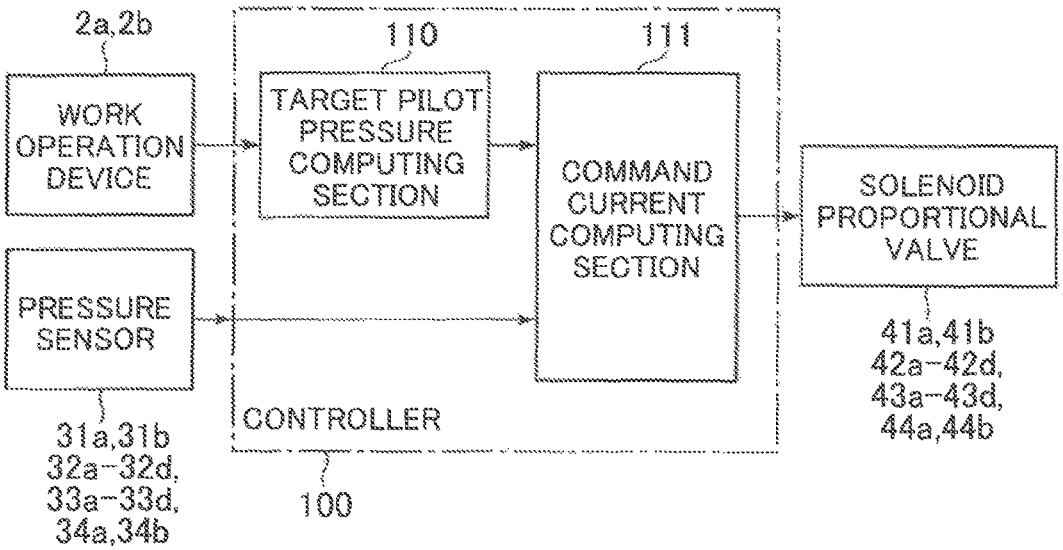
FIG. 3 is a block diagram showing a functional configuration of a controller according to the first embodiment of the present invention.

Details of the controller 100 that is a principal part of the present embodiment will next be described. FIG. 3 is a block diagram showing a functional configuration of the controller 100 according to the present embodiment.

The controller 100 according to the present embodiment has eight target pilot pressure computing sections 110 (only one representative target pilot pressure computing section 110 is shown in FIG. 3) corresponding to the first to eighth potentiometers described above, respectively, and 12 command current computing sections 111 (only one representative command current computing section 111 is shown in FIG. 3) corresponding to the solenoid proportional valves 41*a*, 41*b*, 42*a* to 42*d*, 43*a* to 43*d*, 44*a* and 44*b*, respectively.

Figure 4:
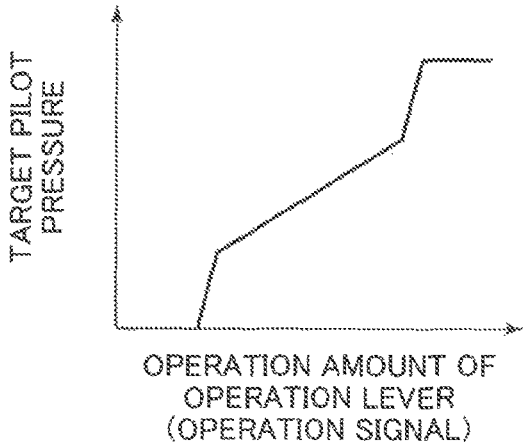
FIG. 4 shows a relationship between an operation amount of an operation lever and a target pilot pressure according to the first embodiment of the present invention.

Each target pilot pressure computing section 110 computes a target pilot pressure for the operation signal input from the corresponding potentiometer using a relationship between the operation amount of the operation lever (in other words, operation signal) and the target pilot pressure shown in FIG. 4, and outputs the target pilot pressure to one or two corresponding command current computing sections 111. It is noted that the relationship between the operation amount of the operation lever and the target pilot pressure similar to that when a hydraulic pilot-type operation device is adopted is preferably used.

Figure 5:
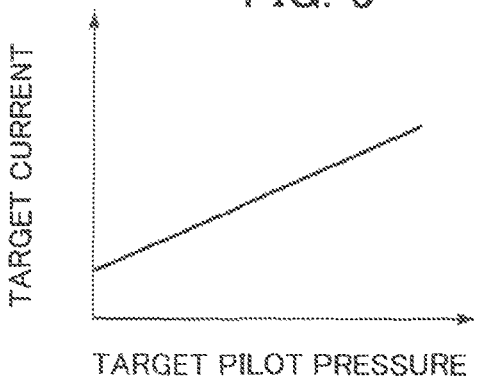
FIG. 5 shows a relationship between the target pilot pressure and a target current according to the first embodiment of the present invention.

Each command current computing section 111 computes a target current for the target pilot pressure input from the corresponding target pilot pressure computing section 110 using a relationship between the target pilot pressure and the target current shown in FIG. 5, and outputs the target current to the solenoid section of the corresponding solenoid proportional valve as a command current.

Figure 6:
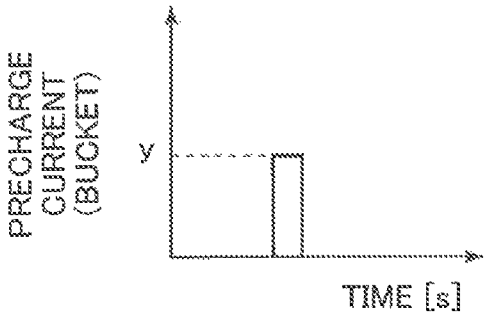
FIG. 6 shows a precharge current according to the first embodiment of the present invention.
Figure 7:
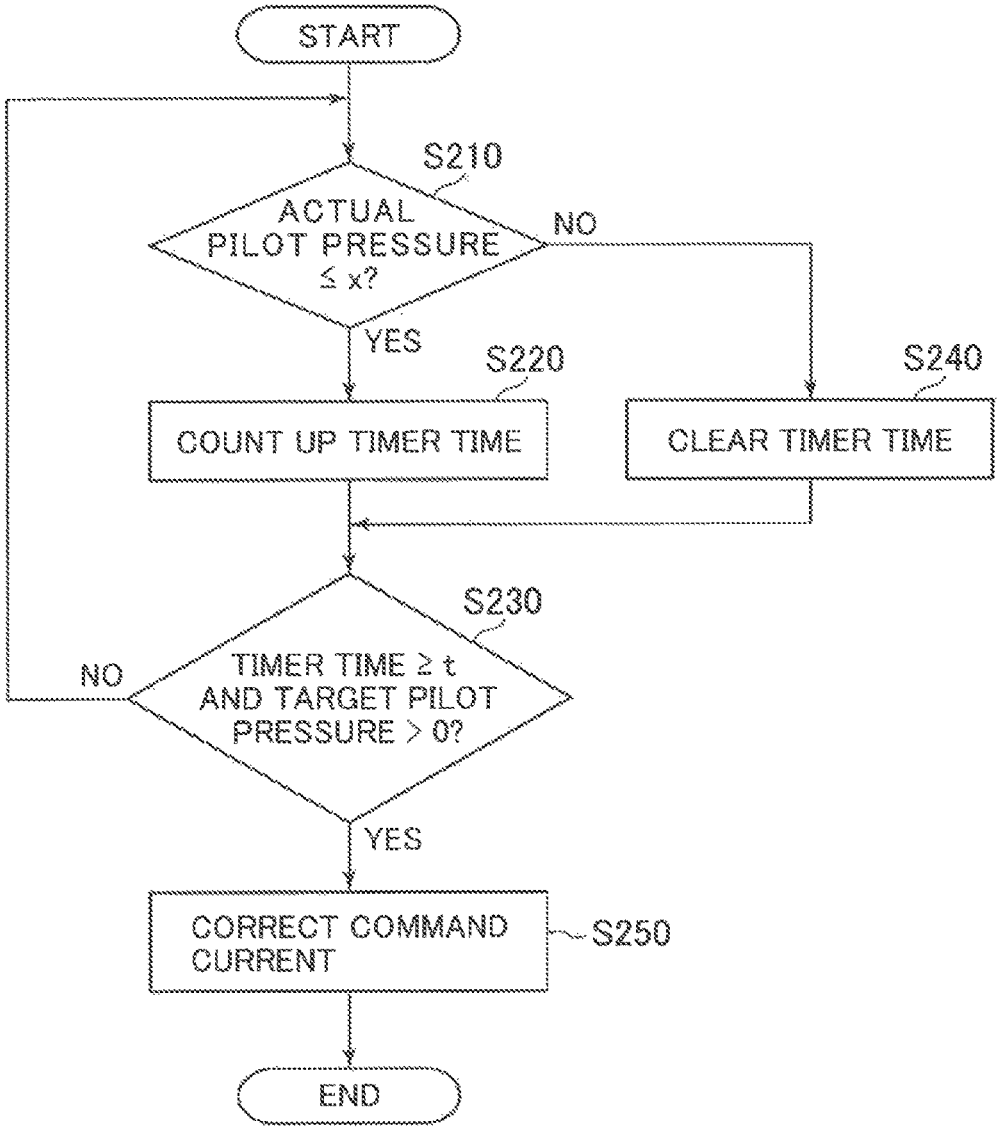
FIG. 7 is a flowchart showing processing procedures related to a correction function of the controller according to the first embodiment of the present invention.

As a notable feature of the present embodiment, only the two command current computing sections 111 related to the bucket cylinder 7 (that is, corresponding to the bucket solenoid proportional valves 44*a* and 44*b*) have a function to correct the command current. More specifically, each of the two command current computing sections 111 has the function to correct the command current in such a manner that the command current is higher than the target current for preset predetermined time at a time of starting to operate the work operation device 2*b* in the direction from the neutral position to the left or right side thereof. That is, at the time of starting to operate the work operation device 2*b* in the direction from the neutral position to the left or right side thereof, a preset correction value y of the command current (hereinafter, referred to as precharge current) is output to the solenoid section of either the bucket solenoid proportional valve 44*a* or 44*b* in such a manner that the command current is higher than the target current for the predetermined time as shown in FIG. 6 (as well as FIG. 8 to be described later). Processing procedures related to this correction function will be described with reference to FIG. 7.

First, in Step S210, the command current computing section 111 related to the bucket cylinder 7 determines whether the actual pilot pressure detected by the bucket pressure sensor 34*a* or 34*b* (in other words, the pilot pressure generated by the bucket solenoid proportional valve 44*a* or 44*b*) is equal to or lower than a preset predetermined threshold x [MPa]. When the actual pilot pressure detected by the bucket pressure sensor 34*a* or 34*b* is equal to or lower than the predetermined threshold x, then a determination result of Step S210 is YES, and processing goes to Step S220, in which the command current computing section 111 counts up timer time. Subsequently, the processing goes to Step S230, in which the command current computing section 111 determines whether the target pilot pressure input from the target pilot pressure computing section 110 is higher than zero and whether the timer time is equal to or longer than preset predetermined time t. When the target pilot pressure is zero or when the timer time is shorter than the predetermined threshold t, then a determination result of Step S230 is NO, the processing returns to Step S210 described above, and similar procedures to those described above are repeated.

When the actual pilot pressure detected by the bucket pressure sensor 34*a* or 34*b* is higher than the predetermined threshold x in Step S210, then the determination result of Step S210 is NO, and the processing goes to Step S240, in which the command current computing section 111 resets the timer time.

When the target pilot pressure is higher than zero and the timer time is equal to or longer than the predetermined threshold t, then the determination result of Step S230 is YES, and the processing goes to Step S250. In Step S250, the command current computing section 111 corrects the command current in such a manner that the command current is higher than the target current for the predetermined time. That is, the command current computing section 111 outputs the precharge current y to the solenoid section of the bucket solenoid proportional valve 44*a* or 44*b* for the predetermined time.

Figure 8:
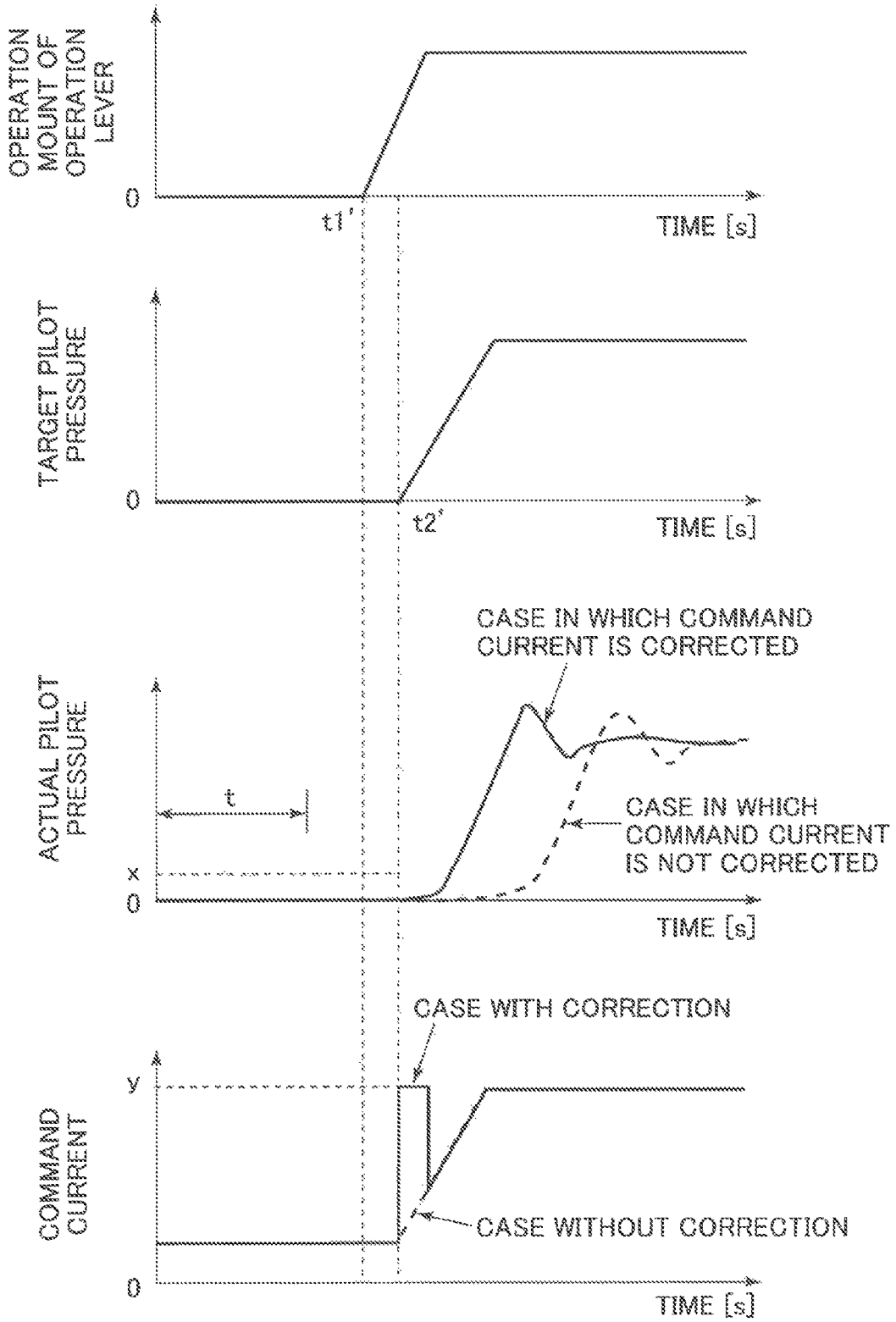
FIG. 8 shows time charts for describing an example of actions according to the first embodiment of the present invention.
Figure 9:
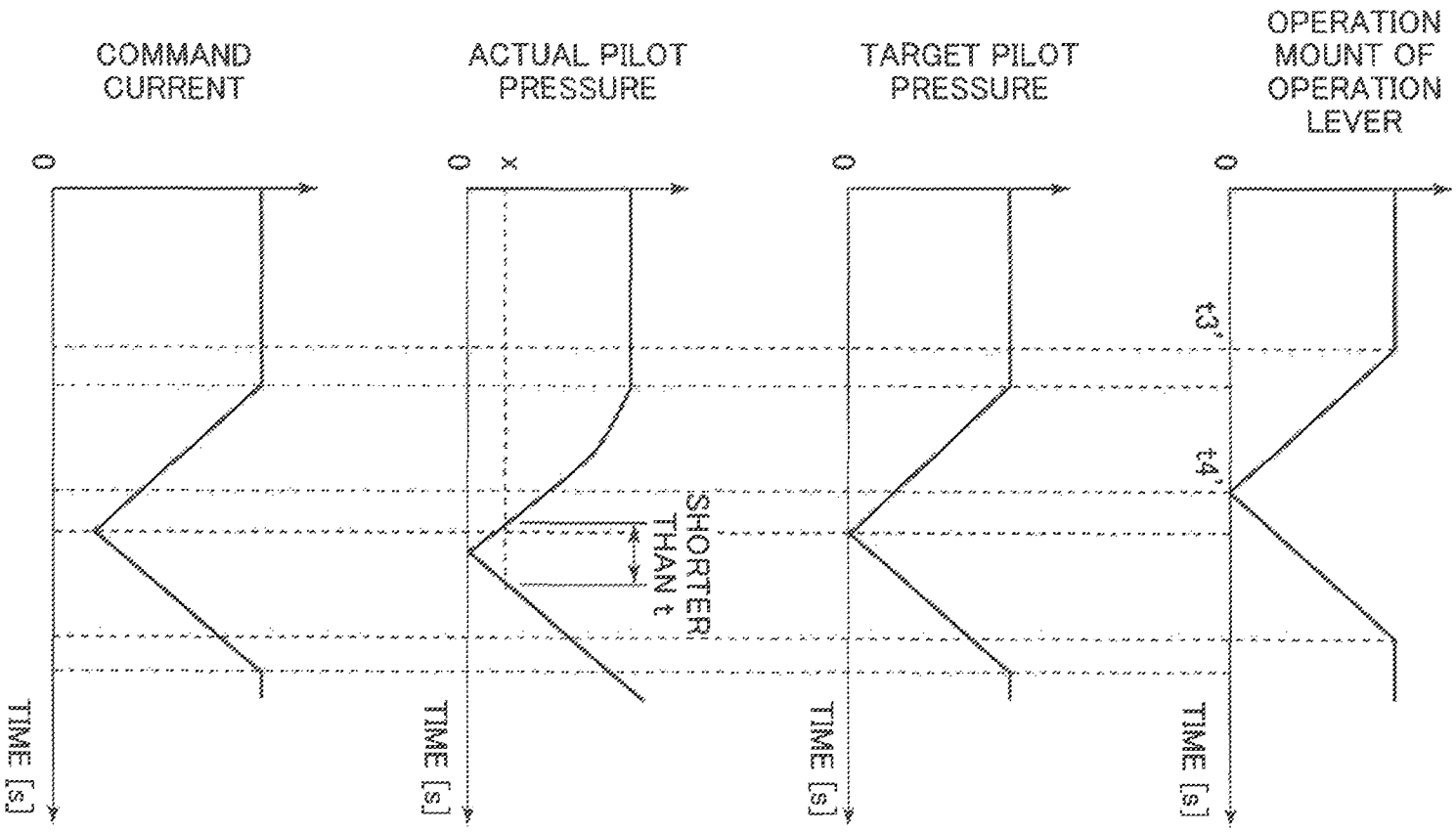
FIG. 9 shows time charts for describing another example of the actions according to the first embodiment of the present invention.

Actions in the present embodiment will next be described with reference to FIGS. 8 and 9. FIGS. 8 and 9 are time charts showing temporal changes of the operation amount of the operation lever, the target pilot pressure, the actual pilot pressure, and the command current related to the bucket cylinder 7. FIG. 8 also shows temporal changes of the command current and the actual pilot pressure in a case in which the command current is not corrected (in other words, the target current is output without outputting the precharge current y).

In FIG. 8, a state in which the operation lever is at the neutral position, the target pilot pressure is zero, and the actual pilot pressure is equal to or lower than the predetermined threshold x continues for the predetermined time t or longer (before time t1'). That is, the state is a state in which the spool of the solenoid proportional valve is completely closed, and an initial motion of the spool is, therefore, delayed. When the operation lever is operated at the time t1', the target pilot pressure is input to the command current computing section 111 at time t2' with a time delay by the potentiometer and target pilot pressure computing section 110. Furthermore, the determination result in Step S230 of FIG. 9 described above is YES and the processing goes to Step S250, the precharge current y is output to the solenoid section of the bucket solenoid proportional valve 44*a* or 44*b* from the command current computing section 111 for the predetermined time, and the target current is then output. It is thereby possible to advance rising of the actual pilot pressure, compared with a case in which the target current is output from the beginning without outputting the precharge current y. Therefore, it is possible to quicken an initial response of the bucket cylinder 7.

In FIG. 9, while the operation lever is returned from a predetermined operation position to the neutral position (from time t3' to time t4'), the target pilot pressure decreases. The actual pilot pressure also decreases to be equal to or lower than the predetermined threshold x. However, a state in which the actual pilot pressure is equal to or lower than the predetermined threshold x does not continue for the predetermined time t or longer since the operation lever is re-operated as soon as being returned to the neutral position. That is, this state is a state in which the spool of the solenoid proportional valve is not completely closed, and the initial motion of the spool is not, therefore, delayed. Furthermore, the determination result in Step S230 of FIG. 9 described above is NO and the target current is, therefore, output from the command current computing section 111 to the solenoid section of the bucket solenoid proportional valve 44*a* or 44*b*.

According to the present embodiment described above, it is possible to quicken only the initial response of the bucket cylinder 7. Therefore, it is possible to ensure the initial response that varies in accordance with the type of hydraulic actuator almost in a similar fashion to the case of adopting the hydraulic pilot-type operation device. As a consequence, the operator can operate the operation device without feeling discomfort.

A second embodiment of the present invention will next be described. In the present embodiment, equivalent parts to those in the first embodiment are denoted by the same reference characters and description thereof will be omitted as appropriate.

In the controller 100 according to the present embodiment, not only the two command current computing sections 111 related to the bucket cylinder 7 (that is, corresponding to the bucket solenoid proportional valves 44*a* and 44*b*, respectively) but also the four command current computing sections 111 related to the arm cylinder 6 (that is, corresponding to the arm solenoid proportional valves 43*a* to 43*d*, respectively), the four command current computing sections 111 related to the boom cylinder 5 (that is, corresponding to the boom solenoid proportional valves 42*a* to 42*d*, respectively), and the two command current computing sections 111 related to the swing motor 4 (that is, corresponding to the swing solenoid proportional valves 41*a* and 41*b*, respectively) have the function to correct the command current. The second embodiment will be described in detail.

Figure 10:
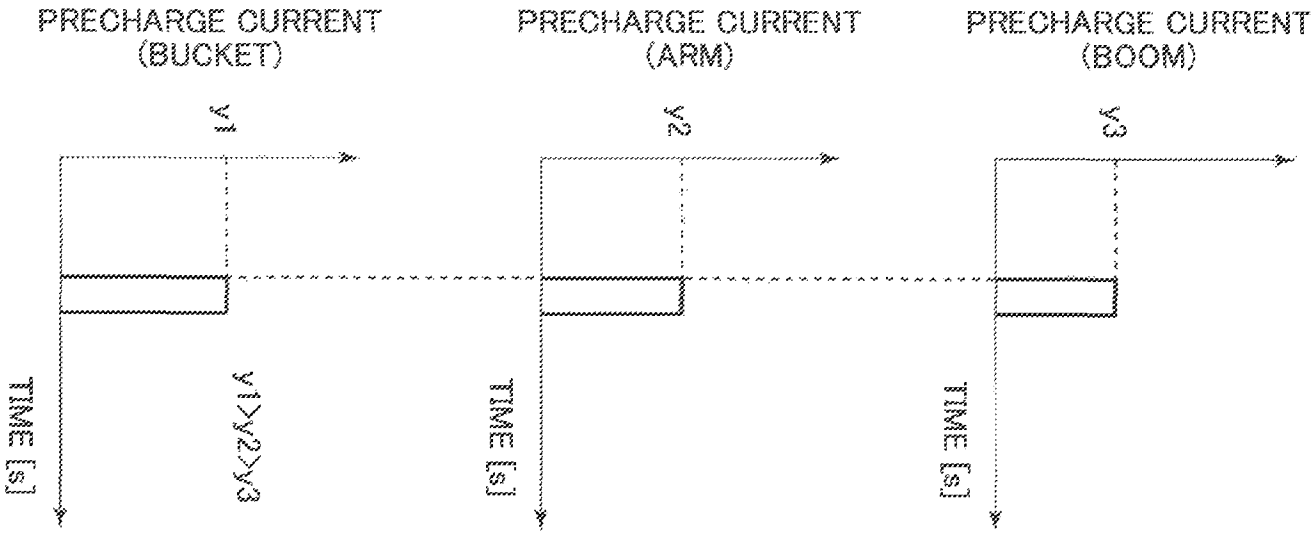
FIG. 10 shows precharge currents according to a second embodiment of the present invention.

Each of the command current computing sections 111 related to the bucket cylinder 7 corrects the command current in such a manner that the command current is higher than the target current for the preset predetermined time at the time of starting to operate the work operation device 2*b* in the direction from the neutral position to the left or right side thereof (specifically, when the state in which the actual pilot pressure detected by the bucket pressure sensor 34*a* or 34*b* is equal to or lower than the predetermined threshold x continues for the predetermined time t or longer and when the target pilot pressure input from the target pilot pressure computing section is higher than zero, similarly to the first embodiment). That is, as shown in FIG. 10, a preset precharge current y1 set such that the precharge current y1 is higher than the target current for the predetermined time is output to the solenoid section of the bucket solenoid proportional valve 44*a* or 44*b*. It is thereby possible to advance rising of the actual pilot pressure, compared with a case in which the precharge current y1 is not output. Therefore, it is possible to quicken an initial response of the bucket cylinder 7.

Each of the command current computing sections 111 related to the arm cylinder 6 corrects the command current in such a manner that the command current is higher than the target current for the predetermined time at the time of starting to operate the work operation device 2*a* in the direction from the neutral position to the left or right side thereof (specifically, when a state in which the actual pilot pressures detected by the arm pressure sensors 33*a* and 33*b* or 33*c* and 33*d* are equal to or lower than the predetermined threshold x continues for the predetermined time t or longer and when the target pilot pressure input from each target pilot pressure computing section is higher than zero). That is, as shown in FIG. 10, a preset precharge current y2 (where y1>y2) set such that the precharge current y2 is higher than the target current for the predetermined time is output to the solenoid sections of the arm solenoid proportional valve 43*a* and 43*b* or 43*c* and 43*d*. It is thereby possible to advance rising of the actual pilot pressures, compared with a case in which the precharge current y2 is not output. Therefore, it is possible to quicken an initial response of the arm cylinder 6.

Each of the command current computing sections 111 related to the boom cylinder 5 corrects the command current in such a manner that the command current is higher than the target current for the predetermined time at the time of starting to operate the work operation device 2*b* in the direction from the neutral position to the front or rear side thereof (specifically, when a state in which the actual pilot pressures detected by the boom pressure sensors 32*a* and 32*b* or 32*c* and 32*d* are equal to or lower than the predetermined threshold x continues for the predetermined time t or longer and when the target pilot pressure input from each target pilot pressure computing section is higher than zero). That is, as shown in FIG. 10, a preset precharge current y3 (where y2>y3) set such that the precharge current y3 is higher than the target current for the predetermined time is output to the solenoid sections of the boom solenoid proportional valve 42*a* and 42*b* or 42*c* and 42*d*. It is thereby possible to advance rising of the actual pilot pressures, compared with a case in which the precharge current y3 is not output. Therefore, it is possible to quicken an initial response of the boom cylinder 5.

Each of the command current computing sections 111 related to the swing motor 4 corrects the command current in such a manner that the command current is higher than the target current for the preset predetermined time at the time of starting to operate the work operation device 2*a* in the direction from the neutral position to the front or rear side thereof (specifically, when a state in which the actual pilot pressure detected by the swing pressure sensor 31*a* or 31*b* is equal to or lower than the predetermined threshold x continues for the predetermined time t or longer and when the target pilot pressure input from the target pilot pressure computing section is higher than zero). That is, although not shown, a preset precharge current y0 (where y0 is nearly equal to y3) set such that the precharge current y0 is higher than the target current for the predetermined time is output to the solenoid section of the swing solenoid proportional valve 41*a* or 41*b*. It is thereby possible to advance rising of the actual pilot pressure, compared with a case in which the precharge current y0 is not output. Therefore, it is possible to quicken an initial response of the swing motor 4.

Furthermore, a relationship of the initial response of the bucket cylinder 7>the initial response of the arm cylinder 6>the initial response of the boom cylinder 5, that is, a relationship among the initial responses for realizing operational feeling similar to that by the hydraulic pilot-type operation device can be obtained from the relationship among the precharge currents (y1>y2>y3) described above. Therefore, it is possible to ensure the initial response that varies in accordance with the type of hydraulic actuator almost in a similar fashion to the case of adopting the hydraulic pilot-type operation device. As a consequence, even when the electric lever-type operation device is used, the operator can operate the electric lever-type operation device without feeling discomfort, compared with the case of adopting the hydraulic pilot-type operation device.

A third embodiment of the present invention will next be described. In the present embodiment, equivalent parts to those in the first and second embodiments are denoted by the same reference characters and description thereof will be omitted as appropriate.

Figure 11:
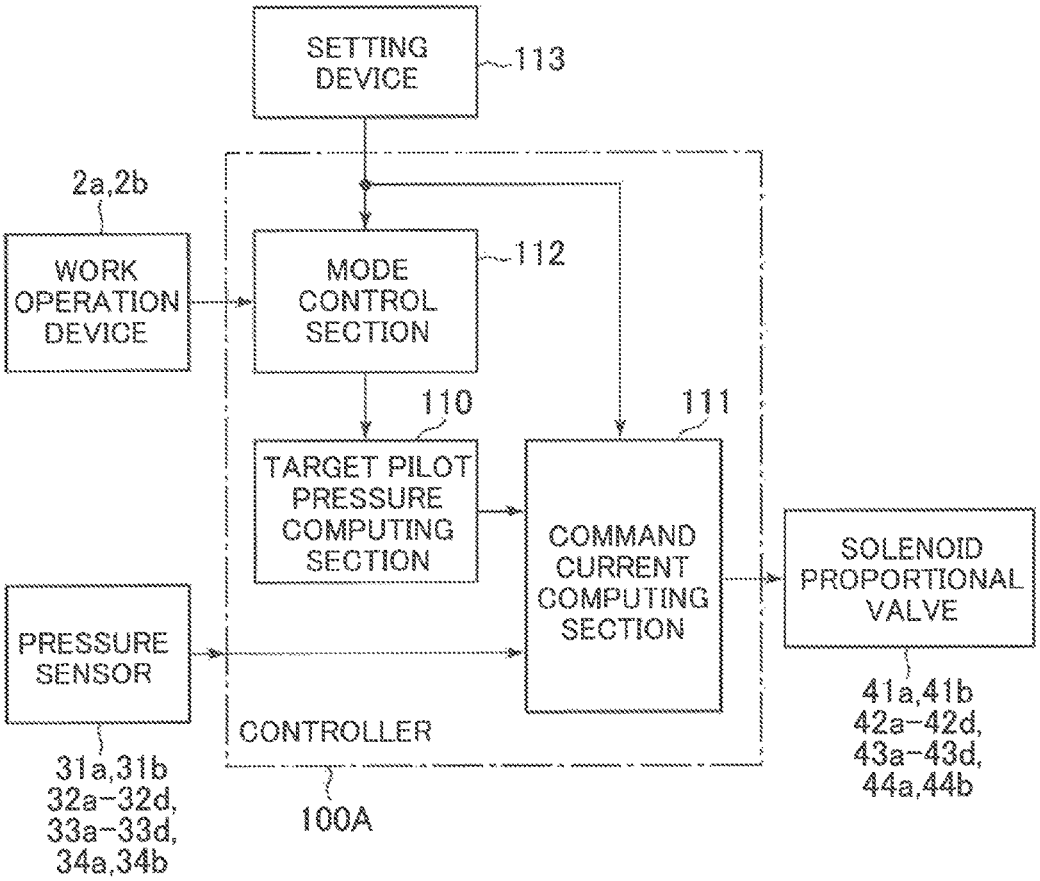
FIG. 11 is a block diagram showing a functional configuration of a controller according to a third embodiment of the present invention.

FIG. 11 is a block diagram showing a functional configuration of a controller according to the present embodiment.

Like the controller 100, a controller 100A of the present embodiment includes the target pilot pressure computing sections 110 and the command current computing sections 111. The controller 100A further includes a mode control section 112, which has a function to selectively execute a manual control mode and an automatic control mode.

A setting device 113 within the operation room 14 selects one of the manual control mode and the automatic control mode in response to operator's operation, and a control parameter when the automatic control mode is selected can be input to the setting device 113. When the manual control mode is selected, a manual control mode setting command is output from the setting device 113 to the mode control section 112 and each command current computing section 111. When the automatic control mode is selected, an automatic control mode setting command is output from the setting device 113 to the mode control section 112 and each command current computing section 111.

The manual control mode is a mode for driving the swing motor 4, the boom cylinder 5, the arm cylinder 6, and the bucket cylinder 7 in accordance with operation on the operation devices 2*a* and 2*b*. The automatic control mode is a mode for driving the swing motor 4, the boom cylinder 5, the arm cylinder 6, and the bucket cylinder 7 on the basis of operation on the operation devices 2*a* and 2*b* in such a manner that an action of any one of the upper swing structure 11, the boom 17, the arm 18, and the bucket 19 is limited or adjusted. Concrete examples of the automatic control mode include a mode for limiting a moving range of the bucket 19 and a mode for adjusting a moving locus of the bucket 19.

When the manual control mode is set, the mode control section 112 outputs the operation signals from the work operation devices 2*a* and 2*b* to the target pilot pressure computing sections 110 as they are. On the other hand, when the automatic control mode is set, the mode control section 112 computes an action position of any one of the upper swing structure 11, the boom 17, the arm 18, and the bucket 19 on the basis of a detection value of a sensor. Furthermore, the mode control section 112 computes a command signal for limiting or adjusting the action of any one of the upper swing structure 11, the boom 17, the arm 18, and the bucket 19 on the basis of the operation signal from the work operation device 2*a* or 2*b*, and outputs the computed command signal to the corresponding target pilot pressure computing section 110.

Figure 12:
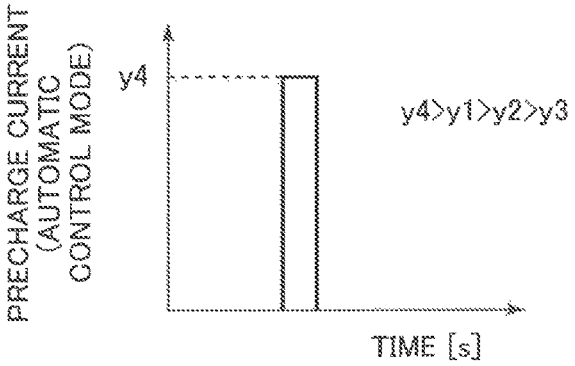
FIG. 12 shows a precharge current according to the third embodiment of the present invention.

Each of the command current computing sections 111 related to the bucket cylinder 7 corrects the command current in such a manner that the command current is higher than the target current for the preset predetermined time at the time of starting to operate the work operation device from the neutral position thereof (specifically, when the state in which the actual pilot pressure detected by the bucket pressure sensor 34*a* or 34*b* is equal to or lower than the predetermined threshold x continues for the predetermined time t or longer and when the target pilot pressure input from the target pilot pressure computing section is higher than zero). At this time, when the manual control mode is set, the preset precharge current y1 set such that the precharge current y1 is higher than the target current for the predetermined time is output to the solenoid section of the bucket solenoid proportional valve 44*a* or 44*b* similarly to the second embodiment. On the other hand, when the automatic control mode is set, a preset precharge current y4 (where y4>y1) set such that the precharge current y4 is higher than the target current for the predetermined time is output to the solenoid section of the bucket solenoid proportional valve 44*a* or 44*b* as shown in FIG. 12. It is thereby possible to advance the rising of the actual pilot pressure, compared with a case in which the precharge current y1 or y4 is not output. Therefore, it is possible to quicken the initial response of the bucket cylinder 7.

Each of the command current computing sections 111 related to the arm cylinder 6 corrects the command current in such a manner that the command current is higher than the target current for the predetermined time at the time of starting to operate the work operation device from the neutral position thereof (specifically, when the state in which the actual pilot pressures detected by the arm pressure sensors 33*a* and 33*b* or 33*c* and 33*d* are equal to or lower than the predetermined threshold x continues for the predetermined time t or longer and when the target pilot pressure input from each target pilot pressure computing section is higher than zero). At this time, when the manual control mode is set, the preset precharge current y2 (where y1>y2) set such that the precharge current y2 is higher than the target current for the predetermined time is output to the solenoid sections of the arm solenoid proportional valves 43*a* and 43*b* or 43*c* and 43*d* similarly to the second embodiment. On the other hand, when the automatic control mode is set, the preset precharge current y4 (where y4>y2) set such that the precharge current y4 is higher than the target current for the predetermined time is output to the solenoid sections of the arm solenoid proportional valves 43*a* and 43*b* or 43*c* and 43*d*. It is thereby possible to advance the rising of the actual pilot pressure, compared with a case in which the precharge current y2 or y4 is not output. Therefore, it is possible to quicken the initial response of the arm cylinder 6.

Each of the command current computing sections 111 related to the boom cylinder 5 corrects the command current in such a manner that the command current is higher than the target current for the predetermined time at the time of starting to operate the work operation device from the neutral position thereof (specifically, when the state in which the actual pilot pressures detected by the boom pressure sensors 32*a* and 32*b* or 32*c* and 32*d* are equal to or lower than the predetermined threshold x continues for the predetermined time t or longer and when the target pilot pressure input from each target pilot pressure computing section is higher than zero). At this time, when the manual control mode is set, the preset precharge current y3 (where y2>y3) set such that the precharge current y3 is higher than the target current for the predetermined time is output to the solenoid sections of the boom solenoid proportional valves 42*a* and 42*b* or 42*c* and 42*d* similarly to the second embodiment. On the other hand, when the automatic control mode is set, the preset precharge current y4 (where y4>y3) set such that the precharge current y4 is higher than the target current for the predetermined time is output to the solenoid sections of the boom solenoid proportional valves 42*a* and 42*b* or 42*c* and 42*d*. It is thereby possible to advance the rising of the actual pilot pressure, compared with a case in which the precharge current y3 or y4 is not output. Therefore, it is possible to quicken the initial response of the boom cylinder 5.

Each of the command current computing sections 111 related to the swing motor 4 corrects the command current in such a manner that the command current is higher than the target current for preset predetermined time at the time of starting to operate the work operation device from the neutral position thereof (specifically, when the state in which the actual pilot pressure detected by the swing pressure sensor 31*a* or 31*b* is equal to or lower than the predetermined threshold x continues for the predetermined time t or longer and when the target pilot pressure input from the target pilot pressure computing section is higher than zero). At this time, when the manual control mode is set, the preset precharge current y0 (where y0 is nearly equal to y3) set such that the precharge current y0 is higher than the target current for the predetermined time is output to the solenoid section of the swing solenoid proportional valve 41*a* or 41*b* similarly to the second embodiment. On the other hand, when the automatic control mode is set, the preset precharge current y4 (where y4>y0) is output to the solenoid section of the swing solenoid proportional valves 41*a* or 41*b*. It is thereby possible to advance the rising of the actual pilot pressure, compared with a case in which the precharge current y0 or y4 is not output. Therefore, it is possible to quicken the initial response of the swing motor 4.

According the present embodiment described above, in the manual control mode, the relationship of the initial response of the bucket cylinder 7>the initial response of the arm cylinder 6>the initial response of the boom cylinder 5, that is, the relationship among the initial responses for realizing the operational feeling similar to that by the hydraulic pilot-type operation device can be obtained from the relationship among the precharge currents (y1>y2>y3) similarly to the second embodiment. Therefore, it is possible to ensure the initial response that varies in accordance with the type of hydraulic actuator almost in the similar fashion to the case of adopting the hydraulic pilot-type operation device. As a consequence, even when the electric lever-type operation device is used, the operator can operate the electric lever-type operation device without feeling discomfort, compared with the case of adopting the hydraulic pilot-type operation device.

On the other hand, in the automatic control mode, responsiveness of each hydraulic actuator takes precedence over operator's operability. That is, in the automatic control mode, the precharge currents are high and the initial responses of the hydraulic actuators can be improved, compared with the manual control mode. Therefore, it is possible to improve work efficiency.

The third embodiment has been described while a case in which the command current computing sections 111 related to the bucket cylinder 7, the arm cylinder 6, the boom cylinder 5, and the swing motor 4 output the precharge current y4 when the automatic control mode is set by way of example. However, the third embodiment is not limited to the case. That is, any of the command current computing sections 111 related to the bucket cylinder 7, the arm cylinder 6, the boom cylinder 5, or the swing motor 4 may output the precharge current y4 when the automatic control mode is set, while the remainder may output the same precharge currents as those in the manual control mode even when the automatic control mode is set. Such a modification can also attain effects similar to those described above.

The first to third embodiments have been described while a case in which the construction machine includes the hydraulic pilot-type travel operation devices is taken by way of example. However, the present invention is not limited to the case and the construction machine may include electric lever-type travel operation devices.

Furthermore, the first to third embodiments have been described while the hydraulic excavator is used as an object to which the present invention is applied. However, the object to which the present invention is applied is not limited to the hydraulic excavator but may be another construction machine. Specifically, the present invention may be applied to, for example, a wheel loader including: a plurality of hydraulic pumps; a bucket directional control valve that controls a flow of a hydraulic fluid from one of the hydraulic pumps to a bucket cylinder; a pair of bucket solenoid proportional valves that generate and output pilot pressures for driving the bucket directional control valve; a plurality of arm directional control valves that control the flow of the hydraulic fluid from the plurality of hydraulic pumps to an arm cylinder; a plurality of pairs of arm solenoid proportional valves that generate and output pilot pressures for driving the plurality of arm directional control valves; an electric lever-type operation device that outputs a first operation signal for operating the bucket cylinder and that outputs a second operation signal for operating the arm cylinder; and a controller that outputs a first command current for driving the bucket solenoid proportional valve in response to the first operation signal from the operation device, and that outputs a second command current for driving the arm solenoid proportional valves in response to the second operation signal from the operation device.

When the present invention is applied to the wheel loader described above, the controller includes a correction function to correct a command current in such a manner that the command current is higher than a target current corresponding to an operation amount of the operation device for preset predetermined time at a time of starting to operate the operation device from a neutral position of the operation device. In addition, the correction function of the controller may correct the first command current for driving the bucket cylinder and not correct the second command current for driving the arm cylinder, similarly to the first embodiment. Alternatively, the correction function may correct the first and second command currents in such a manner that a correction value z1 of the first command current is larger than a correction value z2 of the second command current, similarly to the second embodiment. In another alternative, when the automatic control mode is set, the correction function may correct the first and second command currents to a correction value z3 higher than the correction values z1 and z2, similarly to the third embodiment. In these cases, it is possible to attain similar effects to those described above.

DESCRIPTION OF REFERENCE CHARACTERS

2*a*, 2*b*: Work operation device
5: Boom cylinder
6: Arm cylinder
7: Bucket cylinder
8*a*, 8*b*: Hydraulic pump
17: Boom
18: Arm
19: Bucket
24*a*, 24*b*: Boom directional control valve
25*a*, 25*b*: Arm directional control valve
26: Bucket directional control valve
42*a*, 42*b*, 42*c*, 42*d*: Boom solenoid proportional valve
43*a*, 43*b*, 43*c*, 43*d*: Arm solenoid proportional valve
44*a*, 44*b*: Bucket solenoid proportional valve
100, 100A: Controller

The invention claimed is:

1. A construction machine comprising:

a plurality of hydraulic pumps;

a first directional control valve that controls a flow of a hydraulic fluid from one of the hydraulic pumps to a first hydraulic actuator;

a pair of first solenoid proportional valves that generate and output pilot pressure for driving the first directional control valve;

a plurality of second directional control valves that control the flow of the hydraulic fluid from the plurality of hydraulic pumps to a second hydraulic actuator;

a plurality of pairs of second solenoid proportional valves that generate and output pilot pressures for driving the plurality of second directional control valves;

at least one electric lever-type operation device that outputs a first operation signal for operating the first hydraulic actuator and that outputs a second operation signal for operating the second hydraulic actuator; and a controller that outputs a first command current for driving the first solenoid proportional valve in response to the first operation signal from the operation device, and that outputs a second command current for driving the second solenoid proportional valves in response to the second operation signal from the operation device, wherein the controller includes a correction function to correct a command current in such a manner that the command current is higher than a target current corresponding to an operation amount of the operation device for preset predetermined time at a time of starting to operate the operation device from a neutral position of the operation device, and the correction function of the controller corrects the command current such that the controller corrects the first command current and does not correct the second command current or such that a correction value of the first command current is higher than a correction value of the second command current.

2. The construction machine according to claim 1, wherein the construction machine according to claim 1 is a hydraulic excavator, the first hydraulic actuator is a bucket cylinder, the second hydraulic actuator is an arm cylinder and a boom cylinder, and the correction function of the controller corrects the first command current for driving the bucket cylinder and does not correct the second command current for driving the arm cylinder and the second command current for driving the boom cylinder.

3. The construction machine according to claim 1, wherein the construction machine according to claim 1 is a hydraulic excavator, the first hydraulic actuator is a bucket cylinder, the second hydraulic actuator is an arm cylinder and a boom cylinder, and the correction function of the controller corrects the first command current and the second command currents in such a manner that a relationship of a correction value y1 of the first command current for driving the bucket cylinder>a correction value y2 of the second command current for driving the arm cylinder>a correction value y3 of the second command current for driving the boom cylinder is satisfied.

4. The construction machine according to claim 3, wherein the controller further includes a function to selectively execute a manual control mode for driving the bucket cylinder, the arm cylinder, and the boom cylinder in accordance with operation on the operation device, and an automatic control mode for driving the bucket cylinder, the arm cylinder, and the boom cylinder in such a manner that an action of any one of a bucket, an arm, and a boom is limited or adjusted on basis of the operation on the operation device, and the correction function of the controller, corrects the first and second command values in such a manner that a relationship of the correction value y1 of the first command current for driving the bucket cylinder>the correction value y2 of the second command current for driving the arm cylinder>the correction value y3 of the second command current for driving the boom cylinder is satisfied in a case of the manual control mode, and, corrects the first command current for driving the bucket cylinder, the second command current for driving the arm cylinder, and the second command current for driving the boom cylinder to a correction value y4 larger than the correction values y1, y2, and y3 in a case of the automatic control mode.

* * * * *